US010236588B2

(12) United States Patent
Crouch

(10) Patent No.: US 10,236,588 B2
(45) Date of Patent: Mar. 19, 2019

(54) HIGH-POWERED WIDEBAND TAPERED SLOT ANTENNA SYSTEMS AND METHODS

(71) Applicant: Raytheon Company, Waltham, MA (US)

(72) Inventor: David D. Crouch, Eastvale, CA (US)

(73) Assignee: Raytheon Company, Waltham, MA (US)

( * ) Notice: Subject to any disclaimer, the term of this patent is extended or adjusted under 35 U.S.C. 154(b) by 169 days.

(21) Appl. No.: 15/371,476

(22) Filed: Dec. 7, 2016

(65) Prior Publication Data

US 2018/0159237 A1 Jun. 7, 2018

(51) Int. Cl.

| | |
|---|---|
| ***H01Q 1/48*** | (2006.01) |
| ***H01Q 13/10*** | (2006.01) |
| ***H01Q 9/04*** | (2006.01) |
| ***H01Q 21/26*** | (2006.01) |
| ***H01Q 1/40*** | (2006.01) |
| ***H01Q 13/08*** | (2006.01) |
| ***H01Q 21/06*** | (2006.01) |

(Continued)

(52) U.S. Cl.

CPC ..... *H01Q 13/10* (2013.01); *H01Q 1/40* (2013.01); *H01Q 1/48* (2013.01); *H01Q 9/0485* (2013.01); *H01Q 13/085* (2013.01); *H01Q 21/064* (2013.01); *H01Q 21/24* (2013.01); *H01Q 21/26* (2013.01); *H01Q 25/001* (2013.01)

(58) Field of Classification Search

CPC ..... H01Q 13/10; H01Q 21/26; H01Q 21/00; H01Q 1/48; H01Q 9/0485

USPC ..... 343/797, 727, 767

See application file for complete search history.

(56) References Cited

U.S. PATENT DOCUMENTS 4,814,777 A * 3/1989 Monser ..... H01Q 21/205 343/727

6,072,439 A * 6/2000 Ippolito ..... H01Q 1/246 343/795

6,344,830 B1 2/2002 Taylor (Continued)

FOREIGN PATENT DOCUMENTS

WO WO 2016/099367 A1 6/2016

OTHER PUBLICATIONS

PCT Search Report & Written Opinion of the ISA dated Nov. 15, 2017 from International Application No. PCT/US2017/048371; 18 Pages.

*Primary Examiner* — Hai V Tran

(74) *Attorney, Agent, or Firm* — Daly, Crowley, Mofford & Durkee, LLP

(57) ABSTRACT

An antenna system is provided having a ground plane and a first antenna element disposed over the ground plane. The first antenna element includes first and second fins, each of the first and second fins having an input port and a shape selected such that the fin is responsive to electromagnetic signals provided thereto. The antenna system further includes a second antenna element disposed over the ground plane. The second antenna element includes third and fourth fins, each of the third and fourth fins having an input port and a shape selected such that the fin is responsive to electromagnetic signals provided thereto. The first and second antenna elements are orthogonally arranged with respect to each other such that a slot portion of each of the first and second antenna elements intersect. The antenna system further includes a first substrate disposed about the first and second antenna elements.

24 Claims, 6 Drawing Sheets

(51) Int. Cl.
*H01Q 21/24* (2006.01)
*H01Q 25/00* (2006.01)

(56) References Cited

U.S. PATENT DOCUMENTS

| | | | | |
|---|---|---|---|---|
| 7,106,268 | B1 * | 9/2006 | Angelucci ..... | H01Q 13/08<br>343/770 |
| 7,180,457 | B2 | 2/2007 | Trott et al. | |
| 2004/0004580 | A1 | 1/2004 | Toland et al. | |
| 2006/0038732 | A1 | 2/2006 | DeLuca et al. | |
| 2013/0214980 | A1 | 8/2013 | Lambert et al. | |

* cited by examiner

HIGH-POWERED WIDEBAND TAPERED SLOT ANTENNA SYSTEMS AND METHODS

BACKGROUND

As is known in the art, high power microwave systems, such as those capable of radiating at peak power levels of hundreds of megawatts or more, are normally constructed around a single source of microwave power. In principle, such sources can be used to power array antennas. A corporate feed network is needed to divide and distribute power to each separate array element. However, high power networks are usually constructed from waveguide, which can be heavy and occupy significant volume within an array antenna. Furthermore, waveguide is dispersive and can operate only over a limited bandwidth. It would, therefore, be desirable to provide antenna elements and feeds capable of wideband operation with high power signals. It would also be desirable to reduce the size and/or weight of an array antenna.

SUMMARY

In accordance with one aspect of the concepts, systems and methods described herein, a tapered slot antenna includes a first slot antenna element and a second slot antenna element orthogonally disposed to and intersecting with the first slot antenna element. A dielectric material is disposed over the pair of slot antenna elements. Each slot antenna element is provided from a pair of generally fin-shaped members with each fin-shaped member having a radio frequency (RF) signal port. Each fin-shaped member can be fed from a different signal source to provide space and weight savings within the tapered slot antenna.

With this particular arrangement, a tapered slot antenna capable of operation at high RF powers and over a wide frequency bandwidth is provided. By disposing a dielectric material about the pair of slot antenna elements, the power levels at which electrical breakdown occurs between the fine of the slot antenna elements is increased, thus making the tapered slot antenna suitable for use with high power RF signals. The tapered slot antenna may be used to either transmit or receive RF signals including high power RF signals. Stated differently, the tapered slot antenna may be used in either a receive path or a transmit path of an RF system.

Since each fin-shaped member has an RF signal port, each slot antenna element is provided having a pair of RF signal ports and thus each tapered slot antenna is provided having four RF signal ports. In one embodiment, each RF signal port is provided as an RF coaxial port.

Accordingly, when the tapered slot antenna is disposed in a transmit signal path of an RF system, different RF signal sources may be coupled to different ones of the RF signal ports of the tapered slot antenna. For example, a first RF signal source may be coupled to a first two of the RF signal ports of the tapered slot antenna and a second RF signal source may be coupled to a second two of the RF signal ports of the tapered slot antenna. In this way, the first RF signal source provides RF signals to a first two of the fin-shaped members which make up the tapered slot antenna and the second RF signal source provides RF signals to a second two of the fin-shaped members which make up the tapered slot antenna. Thus, each fin-shaped member need not receive the same RF signal from the same RF signal source (i.e. each fin-shaped member need not receive an RF signal originated from a single, or even the same, RF signal source).

It should be appreciated that there are constraints on the signals feeding various ones of the RF signal ports. Minimization of the reflected signal power at each port requires that diagonally opposing ports be fed with signals of identical frequency and 180 degrees out of phase.

For example, two diagonal pairs need not be driven at the same frequency, however, so the tapered slot antenna can radiate two different frequencies simultaneously. That is, if the two fins that comprise an antenna element are fed with a relative phase of 180°, then the two antenna elements that comprise a tapered slot pair can be driven at different frequencies within the operating bandwidth of the tapered slot antenna.

In some embodiments, fin-shaped members positioned diagonally from each other within the tapered slot antenna can be fed with RF signals having the same frequency and 180° out of phase with respect to each other. Each pair of fin-shaped members positioned diagonally from each other within the tapered slot antenna forms a slot antenna element. Thus, the tapered slot antenna can be configured to radiate two different frequencies simultaneously by providing each slot antenna element an RF signal at a different frequency within an operating bandwidth of the tapered slot antenna.

For example, the tapered slot antenna may include two pairs of fin-shaped members positioned diagonally from each other within the tapered slot antenna (thus four fins) with each pair of diagonally positioned fin-shaped members forming a slot antenna element. Each pair of fin-shaped members can be provided RF signals having a relative phase of 180°. Thus, a first pair of fin-shaped members can be provided RF signals having a first frequency and 180° out of phase with respect to each other and a second pair of fin-shaped members can be provided RF signals having a second frequency and 180° out of phase with respect to each other. Thus, each slot antenna element within the tapered slot antenna can be provided an RF signal at different frequencies within an operating bandwidth of the tapered slot antenna.

It should, of course, be appreciated that while each RF signal port can be driven by a separate RF signal source, proper operation (i.e., minimal reflected power at each RF port) requires that the constraints regarding the RF signals presented at each port in a diagonal pair (as discussed above) be satisfied. The tapered slot antenna will not function at acceptable performance levels in most applications if each RF port is driven by independent signals of arbitrary frequency and/or phase.

For example, in an alternate embodiment, first, second, third, and fourth different RF signal sources may be coupled to respective ones of first, second, third and fourth RF signal ports of the tapered slot antenna. In such an embodiment, a different RF signal source can provide signals to each of the different fin-shaped members which make up the tapered slot antenna such that fin-shaped members positioned diagonally from each other within the tapered slot antenna can be fed with RF signals having the same frequency and 180° out of phase with respect to each other. Thus, unique RF signals may be provided to each of the different fin-shaped members and thus to each of the slot antenna elements. By adjusting the amplitude and phase of the signals provided to each of the different fin-shaped members, each slot antenna element may radiate signals having any desired amplitude and phase (i.e. the tapered slot antenna is provided having polarization diversity).

In one embodiment, each fin includes an individual coaxial feed input port. The coaxial feed inputs may be coupled to a first ends of respective ones of individual coaxial feeds lines (e.g. a coaxial cable). Second ends of the respective coaxial feeds lines may be coupled to respective ones of output ports of different RF signal sources.

In one embodiment, the signal sources may be provided as compact coherent solid-state microwave sources capable of generating wideband pulses having relatively high peak power levels. The coherent outputs of multiple solid-state microwave sources can be used to drive the tapered slot antenna. Thus, the structure described herein may result in significant size and weight savings compared with prior art approaches.

Furthermore, the use of multiple signal sources to provide RF signals and generate desired microwave power levels can reduce a peak power level presented to individual antenna elements of the tapered slot antenna. This may increase the peak power level with which the tapered slot antenna described herein can operate above peak power levels achievable with prior art systems. In an embodiment, the tapered slot antennas provided in accordance with the concepts described herein are capable of operation in the ultra-high frequency (UHF) band and L-bands and can radiate at peak power levels of tens of megawatts when each slot antenna element is one-half wavelength on a side at the highest operating frequency. In some embodiments, a peak power capacity can change (e.g., increase, decrease) responsive to a change in frequency. For example, the peak power capacity decreases with increasing frequency due to a decreasing size of the slot antenna element (assuming each slot antenna element is one-half wavelength on a side at the highest operating frequency).

In one embodiment, the dielectric is provided as a dielectric substrate disposed at least between side-surfaces of at least some of the fin-shaped members. In one embodiment, the dielectric is provided as a dielectric substrate disposed at least between side-surfaces of each of the fin-shaped members. In one embodiment, the dielectric is provided as a dielectric substrate having openings provided therein to accept one or more of the fin-shaped members (e.g., so as to encapsulate the fin-shaped members). In one embodiment, a dielectric is provided as a conformal coating disposed over the fin-shaped members. In short, the dielectric material is selected having characteristics and shape which insulates those regions of each antenna element at which may exist an electric field having an electric field strength sufficient to initiate breakdown.

In one embodiment, a tapered slot antenna provided in accordance with the concepts described herein is capable of operation over a frequency range of about 750 MHz to about 1.25 GHz.

Concepts, systems and methods are provided herein for a high-powered wideband tapered slot antenna that can be used in high-power and wideband frequency operations. For example, and without limitation, in one embodiment, the tapered slot antenna can be used for applications in the range of about 750 MHz to about 1.25 GHz. The concepts described herein, however, may be used in tapered slot antennas operating over any frequency range. In one embodiment, the tapered slot antenna is provided from a pair of antenna elements and a dielectric material disposed over the pair of antenna elements. In one embodiment, each of the antenna elements include at least two generally fin-shaped members (hereinafter "fins") and a substrate disposed about each of the fins. Each fin includes an individual coaxial feed input port. The coaxial feed inputs may be coupled to coaxial feeds lines (e.g. a coaxial cable) such that each of the fins may be coupled to a different signal source. With each fin coupled to a different coherent signal source, each fin can receive power from a different source and thus receive unique input signals. This allows each fin to radiate signals having a desired amplitude and phase and thus the tapered slot antenna has polarization diversity.

In one embodiment, the signal sources may be provided as compact coherent solid-state microwave sources capable of generating wideband pulses at very high peak power levels. The coherent outputs of multiple solid-state microwave sources can be used to drive the tapered slot antenna.

The use of multiple signal sources to generate desired microwave power levels can reduce a peak power level presented to a power transmission/distribution network coupled to the tapered slot antenna. Thus, the structure described herein may result in significant size and weight savings compared with prior art approaches.

The dielectric material disposed about each of the fins of the antenna increases the magnitude of an electric field at which "breakdown" occurs. The dielectric material may be provided as a substrate having a shape selected to insulate those volumes of each antenna element where an electric field strength is sufficient to initiate air breakdown. For example, at sufficiently high peak power levels, the electric fields will ionize surrounding air, causing air breakdown. This occurs at electric fields between 20 kV/cm and 30 kV/cm. The dielectric material may have a dielectric strength that is greater than that of air (e.g., 200 kV/cm or higher compared to 20-30 kV/cm for air). The dielectric material can be applied to the tapered slot antenna such that it fills cavities within the tapered slot antenna that would otherwise comprise air. Thus, the dielectric material can protect the tapered slot antenna against electric fields (e.g., between 20 kV/cm and 30 kV/cm) that can ionize surrounding air.

In some embodiments, the dielectric material may encapsulate each of the fins within the antenna elements and serve to reduce a vertical profile of the antenna elements by reducing an effective wavelength within the dielectric material. Thus, the tapered slot antenna is a wideband array element capable of radiating wideband pulses of microwave radiation without electrical breakdown.

The tapered slot antenna may be provided from a pair of tapered slot antenna elements, with each of the tapered slots antenna elements having two independent coaxial feeds. The combination of two antennas and four feeds facilitates polarization diversity. For example, by controlling a relative phase of one or more of the four inputs, each element can be made to radiate horizontal or vertical linear polarization, or right-hand or left-hand circular polarization. In some embodiments, the polarization state can be changed substantially instantaneously simply by modifying a relative input phase provided to one or more of the four independent coaxial feeds.

In accordance with a first aspect of the concepts, circuits, systems and techniques described herein, an antenna system comprises a ground plane and a first antenna element disposed over said ground plane. The first antenna element comprises first and second fins spaced apart so as to provide a slot there between and thereby form a first slot antenna element. Each of the first and second fins having an input port and a shape selected such that the fin is responsive to electromagnetic signals provided thereto. The antenna system further comprises a second antenna element disposed over said ground plane. The second antenna element comprising third and fourth fins, each of the third and fourth fins having an input port and a shape selected such that the fin is responsive to electromagnetic signals provided thereto. The first and second antenna elements are orthogonally arranged with respect to each other such that a slot portion of each of the first and second antenna elements intersect. The antenna system further comprises a first substrate disposed about the first and second antenna elements.

The slot portion of the first antenna element is formed by a spacing between the first and second fins and the slot portion of the second antenna element is formed by a spacing between the third and fourth fins. In some embodiments, the first and second antenna elements each comprise a tapered slot antenna.

Each of the first, second, third and fourth fins include a feed portion. The feed portion comprises a circular transition from the feed portion to a radiating portion of each of the first, second, third and fourth fins.

A second substrate may be disposed between each of the first, second, third, and fourth fins and the ground plane. Each of the first, second, third, and fourth fins comprise a feed slot and the second substrate is disposed in the feed slot. In one illustrative embodiment, a length of the feed slot is approximately one quarter wavelength at the center frequency.

In some embodiments, the input ports are coupled to coaxial transmission lines. Each of the coaxial transmission lines includes an inner conductor that extends through a hole formed in the ground plane and the second substrate. Each of the first, second, third and fourth fins can be arranged to radiate at least one of linear or circular polarization, based upon a relative phase applied to the respective input ports through the coaxial transmission lines.

In another aspect, an array of antenna elements comprises a ground plane and a plurality of first antenna elements disposed over said ground plane. Each of said first antenna element comprises first and second fins, each of the first and second fins having an input port and a shape selected such that the fin is responsive to electromagnetic signals provided thereto. The array further comprises a plurality of second antenna element disposed over said ground plane. Each of said second antenna element comprising third and fourth fins, each of the third and fourth fins having an input port and a shape selected such that the fin is responsive to electromagnetic signals provided thereto. In an embodiment, pairs of first and second antenna elements are orthogonally arranged with respect to each other such that a slot portion of each pair of the first and second antenna elements intersect. The array further comprises a first substrate disposed about the plurality of first and second antenna elements.

The pairs of first and second antenna elements can be organized in regular spacing along a surface of the ground plane. The slot portion of the first antenna element is formed by a spacing between the first and second fins and the slot portion of the second antenna element is formed by a spacing between the third and fourth fins.

Each of the first, second, third, and fourth fins include a feed portion. The feed portion comprises a circular transition from the feed portion to a radiating portion of each of the first, second, third, and fourth fins. A feed slot can be formed between a bottom portion of each of the first, second, third, and fourth fins and the ground plane, said feed slot having a second substrate disposed therein.

Each of the input ports can be coupled to an inner conductor of a coaxial transmission line, and each of the inner conductors extends through holes formed in the ground plane and the second substrate. The pairs of first and second antenna elements can be arranged to radiate at least one of linear or circular polarization, based upon a relative phase applied to the respective input ports through the coaxial transmission lines.

The array may include a plurality of coaxial transmission lines with each of the plurality of coaxial transmission lines having an inner conductor and an outer conductor. Each inner conductor can be disposed through and spaced apart from the ground plane and coupled to a portion of at least one first, second, third or fourth fin-shaped members and each outer conductor of the plurality of coaxial transmission lines can be coupled to the ground plane.

In another aspect, a method for controlling a polarization of an antenna is provided. The method comprises providing a first input signal to a first fin-shaped member and a second input signal to a second fin-shaped member, each of said first and second fin-shaped members arranged to form a first antenna element and providing a third input signal to a third fin-shaped member and a fourth input signal to a fourth fin-shaped member, each of said third and fourth fin-shaped members arranged to form a second antenna element. The first and second antenna elements are orthogonally arranged with respect to each other such that a slot portion of each of the first and second antenna elements intersect and said first and second antenna elements form a tapered slot antenna. The method further comprising modifying a phase provided to at least one of the first, second, third or fourth input signals to change a polarization of the tapered slot antenna such that the tapered slot antenna radiates in at least one of a linear polarization or a circular polarization. It should be appreciated that to realize polarization diversity (e.g., linear, circular) all four RF inputs must receive RF signals having the same frequency. For example, each of the first, second, third and fourth input signals may be provided at the same frequency for polarization diversity.

The method may further comprise generating the circular polarization by driving neighboring input ports of each of first, second, third, and fourth fin-shaped members with input signals having a relative phase shift of 90°. In some embodiments, the method further comprises generating at least one of a vertical linear polarization or a horizontal linear polarization by driving neighboring input ports of at least two of first, second, third and fourth fin-shaped members with input signals having a relative phase of 180° with respect to the input signals provided to the other two of first, second, third and fourth fin-shaped members.

In another aspect, an antenna system is provided having a ground plane and a first antenna element disposed over the ground plane. The first antenna element having first and second fin-shaped members disposed to form a first slot antenna element. Each of the first and second fin-shaped members having an input port. The first and second fin-shaped members have a feed portion and a feed slot. The feed portion includes a circular transition from the feed portion to a radiating portion of each of the first and second fin shaped members. The feed slot is formed between each of said first and second fin-shaped members and the ground plane. A substrate can be disposed in the feed slot between the respective feed portions and the ground plane.

In some embodiments, the antenna system further comprises a second antenna element disposed over the ground plane. The second antenna element having third and fourth fin-shaped members disposed to form a second slot antenna element. Each of the third and fourth fin-shaped members having an input port. The third and fourth fin-shaped members include the feed portion and the feed slot. The feed portion having the circular transition from the feed portion to a radiating portion of each of the third and fourth fin shaped members, and the feed slot is formed between each of said third and fourth fin-shaped members and the ground plane. The substrate may be disposed in the feed slot between the respective feed portions and the ground plane. The first and second antenna elements can be orthogonally arranged with respect to each other such that a slot portion of each of the first and second antenna elements intersect.

BRIEF DESCRIPTION OF THE DRAWINGS

The foregoing concepts and features may be more fully understood from the following description of the drawings. The drawings aid in explaining and understanding the disclosed technology. Since it is often impractical or impossible to illustrate and describe every possible embodiment, the provided figures depict one or more illustrative embodiments. Accordingly, the figures are not intended to limit the scope of the concepts, systems and techniques described herein. Uke numbers in the figures denote like elements.

DETAILED DESCRIPTION

Figure 1:
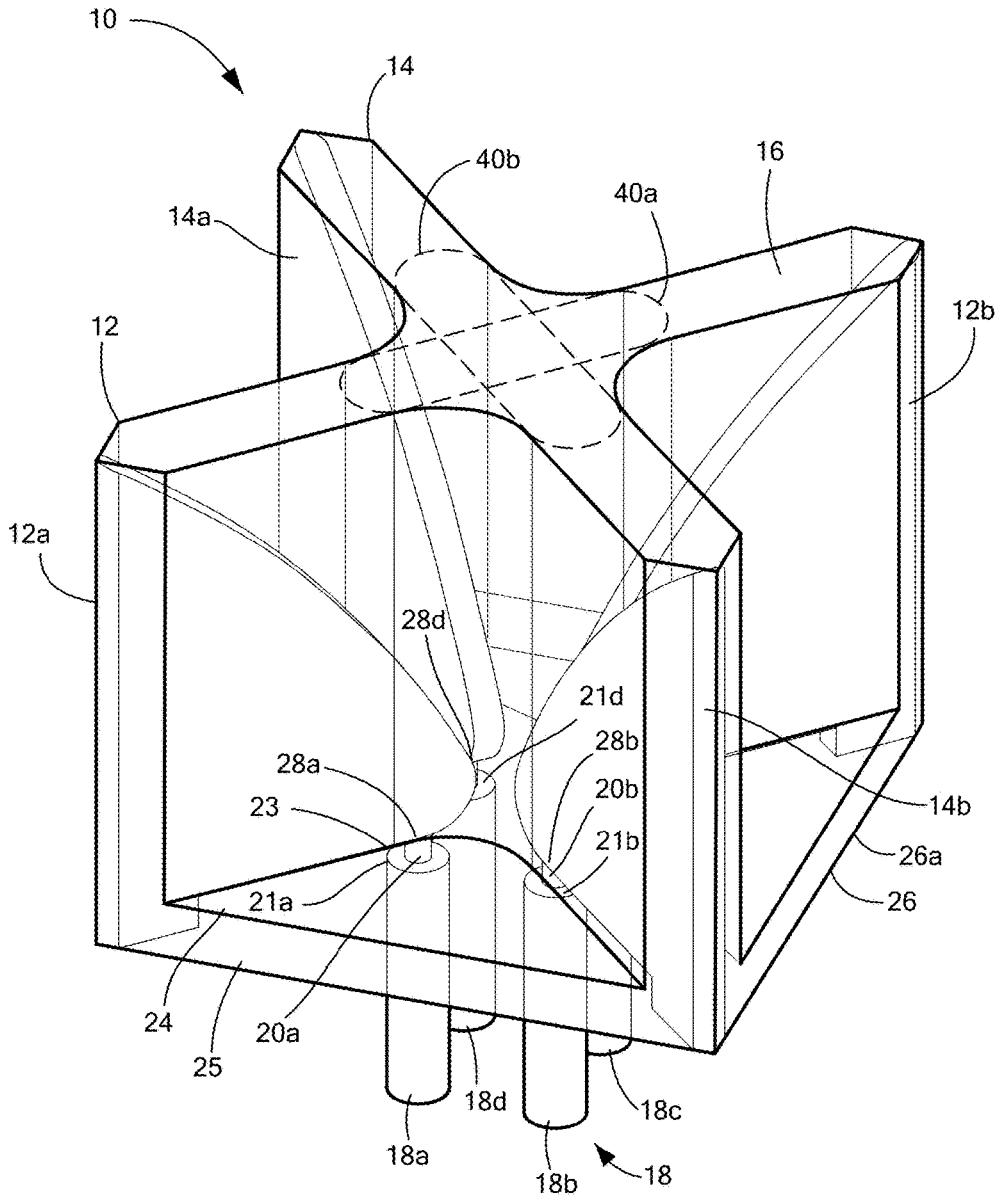
FIG. 1 is an isometric view of a tapered slot antenna in the form of an array unit cell.
Figure 1A:
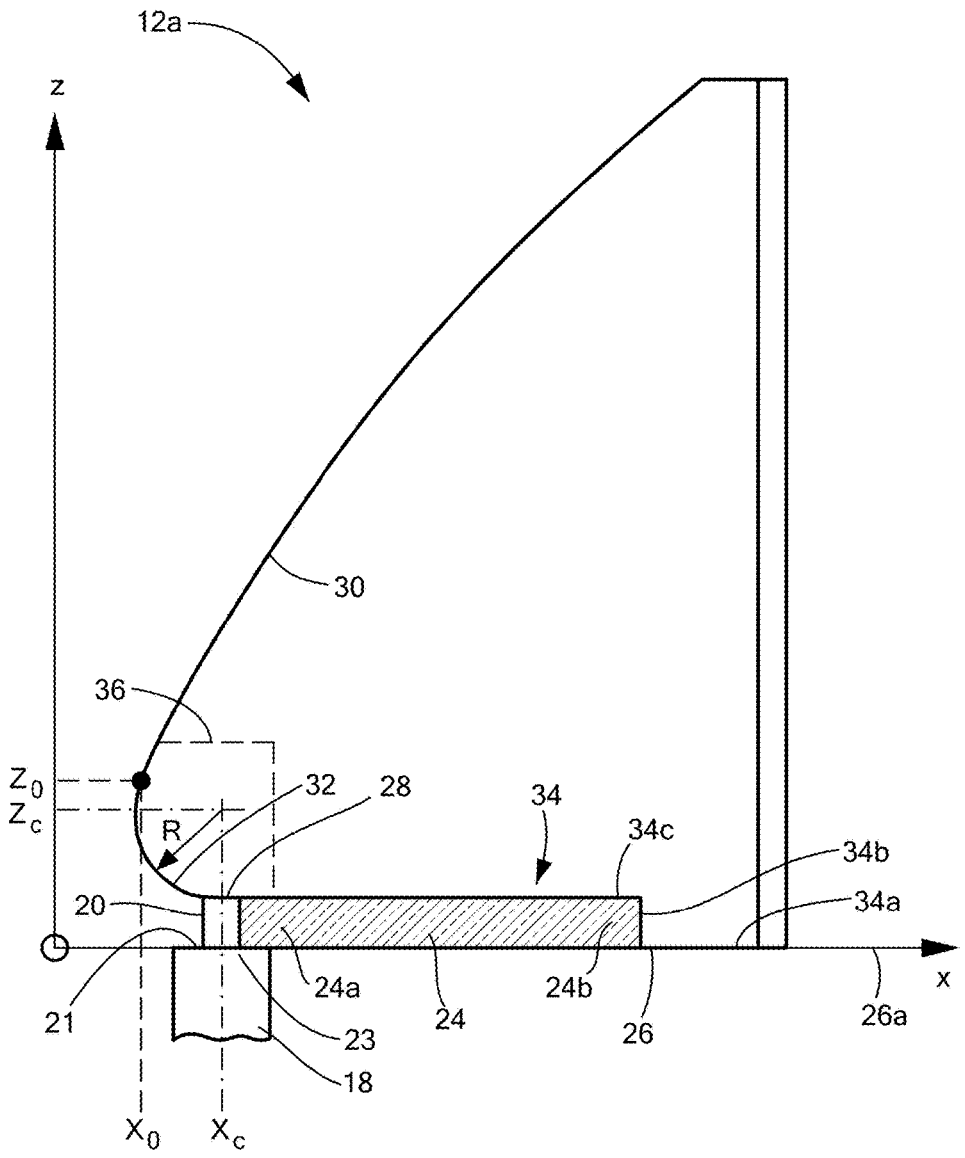
FIG. 1A is a side view of a radiating fin of an antenna element having a coaxial feed, a circular feed transition and an exponential taper.
Figure 1C:
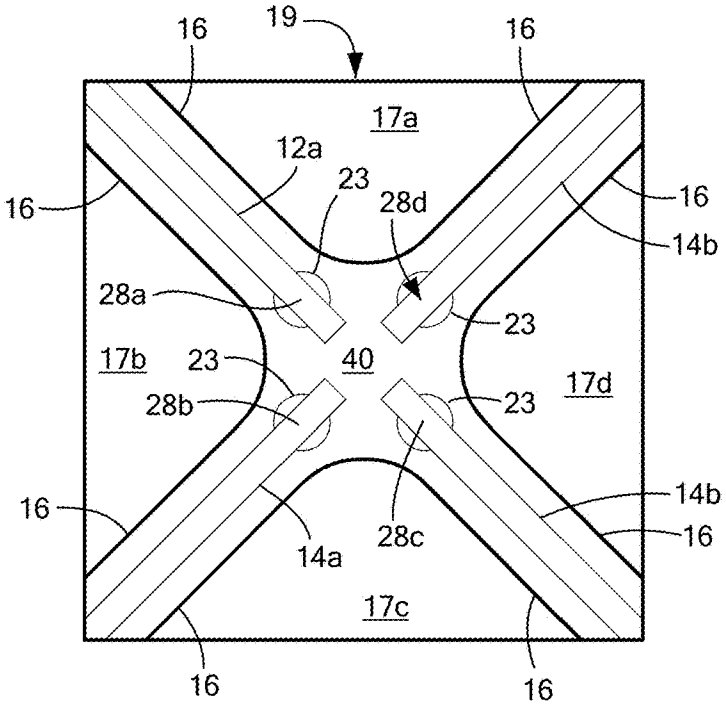
FIG. 1C is a top view of a tapered slot antenna in the form of an array unit cell.

Now referring to FIGS. 1-1C, in which like elements are provided having like reference designations throughout the several views, a tapered slot antenna 10 includes first and second antenna elements 12, 14. The first antenna element 12 includes first and second electrically conductive fin-shaped members (or more simply "fins") 12*a*, 12*b* spaced apart so as to form a first radiating slot 40*a*. Similarly, the second antenna element 14 includes third and fourth electrically conductive fins 14*a*, 14*b* spaced apart so as to form a second radiating slot 40*b*. The first and second antenna elements 12, 14 are orthogonally arranged with respect to each other and intersect with the point of intersection corresponding to the first and second radiating slots 40*a*, 40*b*.

A dielectric material 16 is disposed about first and second antenna elements 12, 14. The dielectric material 16 encapsulates conductive fins 12*a*, 12*b*, 14*a*, 14*b*. The dielectric material 16 may be disposed such that it covers a unit cell formed by first and second antenna elements 12, 14. In general, the dielectric material 16 is provided having electrical characteristics and a shape selected so as to occupy those regions of each antenna element 12, 14 at which may exist an electric field having an electric field strength sufficient to initiate breakdown near or at conductive surfaces of the fins. It should be appreciated that a high electric field could initiate breakdown in the air near a conductor surface without initiating an arc between two conductors.

In the illustrative embodiment of FIGS. 1-1C, for example, the dielectric material is provided as a dielectric substrate 16 having a substantially square or rectangular shape that is substantially the same size as the unit cell formed by first and second antenna elements 12, 14. Substrate 16 is applied to or otherwise disposed over first and second antenna elements 12, 14. In some embodiments, the substrate 16 may be formed or otherwise disposed about fins 12*a*, 12*b*, 14*a*, 14*b* such that first substrate 16 encases each of the first, second, third and fourth fins 12*a*, 12*b*, 14*a*, 14*b*. An illustrative example of substrate 16 will be described in greater detail below with respect to FIG. 1C.

The first and second antenna elements 12, 14 are disposed over a surface 26*a* (here a first or top surface) of a ground plane 26 (FIG. 1A). A feed slot 24 (FIG. 1A) may be formed between a bottom portion of each of the first, second, third and fourth fins 12*a*, 12*b*, 14*a*, 14*b* and ground plane 26. The feed slot 24 may include a second substrate 25 (FIG. 1B) that separates a portion of each of the first, second, third and fourth fins 12*a*, 12*b*, 14*a*, 14*b* and ground plane 26. For example, second substrate 25 may be disposed over the surface 26*a* of ground plane 26 and thus fill a space or cavity formed by feed slot 24 between the bottom portion of each of the first, second, third and fourth fins 12*a*, 12*b*, 14*a*, 14*b* and ground plane 26.

Ground plane 26 and second substrate 25 may include one or more holes 23 to allow a connection between a coaxial transmission line 18 and each of first, second, third and fourth fins 12*a*, 12*b*, 14*a*, 14*b*. For example, each of first, second, third and fourth fins 12*a*, 12*b*, 14*a*, 14*b* include an individual input port 28*a*, 28*b*, 28*c*. 28*d* respectively. Each of the input ports 28*a*, 28*b*, 28*c*, 28*d* may be coupled to a respective one of coaxial transmission lines 18*a*, 18*b*, 18*c*, 18*d* to provide an individual feed to each of first, second, third and fourth fins 12*a*, 12*b*, 14*a*, 14*b*. In some embodiments, the number of holes 23 formed in ground plane 26 and substrate 25 corresponds to the number of fins 12*a*, 12*b*, 14*a*, 14*b* and thus, the number of input ports 28*a*, 28*b*, 28*c*, 28*d* (here four).

Coaxial transmission lines 18*a*, 18*b*, 18*c*, 18*d* may include an outer conductor 21*a*, 21*b*, 21*c*, 21*d* and an inner (or center) conductor 20*a*, 20*b*, 20*c*, 20*d*, respectively. Outer conductors 21*a*, 21*b*, 21*c*, 21*d* may be in contact with ground plane 26 and each of inner conductors 20*a*, 20*b*, 20*c*, 20*d* may extend through the holes 23 formed in ground plane 26 and substrate 25 to electrically couple to a respective one of input ports 28*a*, 28*b*, 28*c*, 28*d*. For example, and without limitation, inner conductors 20*a*, 20*b*, 20*c*, 20*d* may couple to input ports 28*a*, 28*b*, 28*c*, 28*d* through a solder connection, a compression connection, or other mechanical connection.

Now referring to FIG. 1A, fin 12*a* includes a taper 30, a feed portion 36 and a bottom portion 34. Feed portion 36 includes an input port 28 and a transition 32 that provides a transition from the feed portion 36 to taper 30. Transition 32 may be a circular transition and taper 30 may be an exponential taper. In an embodiment, fin 12*a* can be a singular representation of each one of fins 12*a*, 12*b*, 14*a*, 14*b* described above with respect to FIG. 1, thus each of fins 12*a*, 12*b*, 14*a*, 14*b* may have the same or substantially similar properties and dimensions.

Fin 12*a* is disposed over ground plane 26. Second substrate 25 may be disposed within a feed slot 24 formed between ground plane 26 and fin 12*a*. Feed slot 24 can be formed under bottom portion 34 of fin 12*a*. In an embodiment, feed slot 24 can be a cavity region formed between the bottom portion 34 and ground plane 26. For example, and as illustrated in FIG. 1A, the bottom portion 34 of fin 12*a* may include a first portion 34*a* that is coupled to ground plane 26, a second portion 34*b* that is substantially perpendicular to ground plane 26 and a third region 34*c* that is parallel with ground plane 26 but disposed a distance equal to a length of second portion 34*b* above ground plane 26.

Second substrate 25 can be disposed in feed slot 24 such that it fills the cavity region formed by feed slot 24. For example, second substrate 25 can be disposed over a top surface 26*a* of ground plane 26 and under bottom portion 34*c*. Hole 23 can be formed in ground plane 26 and second substrate 25 to allow a connection from coaxial transmission line 18 to input port 28 on fin 12*a*.

Coaxial transmission line 18 includes outer conductor 21 and inner conductor 20. Inner conductor 20 can extend through hole 23 to couple with input port 28 on fin 12*a*. In some embodiments, a diameter of hole 23 formed in the ground plane 26 and second substrate 25 can be equal to a diameter of an insulation separating inner conductor 20 and outer conductor 21 within coaxial transmission line 18. The insulation may include a dielectric material. The insulation may be the same as first substrate 16 and/or second substrate 25. In some embodiments, the insulation may be different from first substrate 16 and/or second substrate 25. Coaxial transmission line 18 may provide an input signal (e.g., electromagnetic signal) to fin 12*a* through inner conductor 20 and input port 28.

Input port 28 may be positioned at one end of bottom portion 34 such that is it at a junction or a first end 24*a* of feed slot 24. The dimensions (e.g., length, height) of feed slot 24 can be selected such that reflections from second portion 34*b* at a second end 24*b* of feed slot 24 are in phase with the input signal provided at input port 28. For example, the input signal can be received at input port 28. A first portion of the input signal may travel along taper 30 and a second portion may travel through feed slot 24. The second portion of input signal can travel through substrate 25 filling feed slot 24, reflect off of second portion 34*b*, travel back through substrate 25 and return in phase with another input signal provided at input port 28. Thus, the returning second portion of the input signal can add in phase with a subsequent different input signal provided at input port 28. In some embodiments, a length of feed slot 24 is approximately equal to one quarter wavelength of a center operation frequency.

A shape of fin 12*a* may be selected such that fin 12*a* is responsive to electromagnetic signals provided at input port 30. For example, taper 30 may be an exponential taper. A slope of taper 30 can be represented by the following equation:

$$X=X_0+A(e^{b(z-z0)}-1)$$

in which:

$X_0$, $Z_0$ are the coordinates of a point occurring at a junction between taper 30 and transition 32.

A represents an amplitude of the exponential taper in units of length. It should be appreciated that the amplitude can be selected such that it yields a desired width of the tapered slot at the aperture.

b represents the growth rate in units of $(\text{length})^{-1}$.

Transition 32 has a radius R and has a center at a point $(X_C, Z_C)$ where:

$$X_C = X_0 + \frac{R}{\sqrt{1 + A^2b^2}}$$

$$Z_C = Z_0 + \frac{AbR}{\sqrt{1 + A^2b^2}}$$

In an embodiment, a smooth transition (here circular) from transition 32 to taper 30 prevents reflections and/or high peak fields values that might occur otherwise. Thus, both the value and slope of the equations above defining the transition 32 and taper 30 can be continuous at the junction (X0, Z0).

Figure 1B:
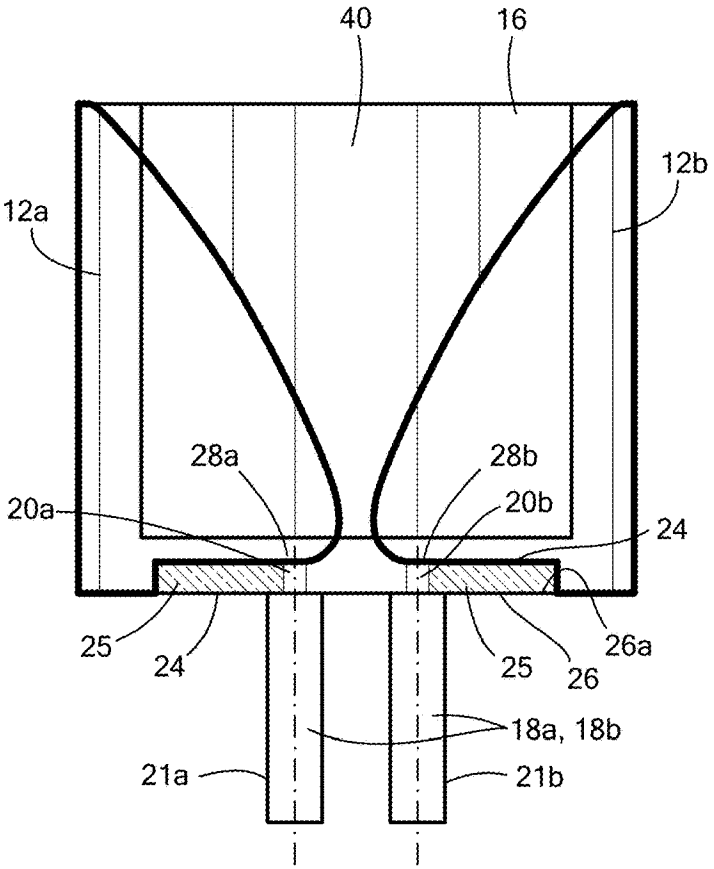
FIG. 1B is a side view of a pair of radiating fins forming an antenna element.

Fin 12*a* may be spaced across (e.g., diagonally) from a second fin to form the first antenna element having a pair of generally diagonal fin-shaped members. For example, and referring to FIG. 1B, which illustrates first and second fins 12*a*, 12*b* without third and fourth fins 14*a*, 14*b*. In FIG. 1B, first and second fins 12*a*, 12*b* of first antenna element 12 are spaced generally diagonally at a predetermined distance from each other and a slot 40 is formed between them. In some embodiments, first and second fins 12*a*, 12*b* are spaced such that they are not in contact and are separated by a distance equal to slot 40.

First substrate 16 may be disposed over first and second fins 12*a*, 12*b* (e.g., encasing them) and over slot 40. In an embodiment, breakdown-free operation at high peak power levels can be facilitated by encapsulating high-field regions in insulating material, here substrate 16. In some embodiments, first substrate 16 may be used to fill slot 40 and be disposed over first and second fins 12*a*, 12*b*. In other embodiments, a different substrate material may be used to fill slot 40 from the substrate material that is disposed over first and second fins 12*a*, 12*b*.

First and second fins 12*a*, 12*b* of first antenna element 12 may be grouped with third and fourth fins 14*a*, 14*b* of second antenna element 14 to form a unit cell 19. First and second antenna element 12, 14 may be disposed within unit cell 19 such that they crisscross unit cell 19. For example, and now referring to FIG. 1C, a top view of tapered slot antenna 10 illustrates first and second antenna elements 12, 14 arranged such that they are orthogonal with respect to each other and their respective radiating slots 40 intersect within unit cell 19. First substrate 16 is disposed over each of first, second, third and fourth fins 12*a*, 12*b*, 14*a*, 14*b* and slot 40.

First substrate 16 may be used to replace air (i.e., physically occupy space which were previously air-filled) in high field regions within tapered slot antenna 10. That is, the substrate simply replaces air in high-peak field regions with a material having a greater dielectric strength. For example, first substrate 16 may have a dielectric strength that is greater than that of air (e.g., 200 kV/cm or higher compared to 20-30 kV/cm for air). First substrate 16 can be applied to tapered slot antenna 10 such that it fills cavities within tapered slot antenna 10 that would otherwise be air-filled. For example, the electromagnetic fields provided at each of the input ports 28*a*, 28*b*, 28*c*, 28*d* can ionize when exposed to air and interfere with the operation of tapered slot antenna 10. Thus, first substrate 16 may confine fields having the potential for causing air breakdown within the first substrate 16. In some embodiments, first substrate 16 may have a dielectric strength (i.e., a maximum voltage required to produce a dielectric breakdown through substrate 16, measured in Volts per unit thickness) that is higher than that of air.

First substrate 16 may be formed or otherwise disposed about the first and second antenna elements 12, 14 such that first substrate 16 encases each of the first, second, third and fourth fins 12*a*, 12*b*, 14*a*, 14*b* and slot 40. For example, first substrate 16 may be applied directly to each of the first, second, third and fourth fins 12*a*, 12*b*, 14*a*, 14*b* to form a layer over each of the respective fins 12*a*, 12*b*, 14*a*, 14*b*. Slot 40 may be filled with first substrate 16. Cavities 17*a*, 17*b*, 17*c*, 17*d* (e.g., voids and/or chambers of open air) may be formed between each of the first, second, third and fourth fins 12*a*, 12*b*, 14*a*, 14*b*. In an embodiment, cavities 17*a*, 17*b*, 17*c*, 17*d* may be formed from regions within unit cell 19 where first substrate 16 is not disposed. Thus, a shape of the first substrate 16 may be the same as or substantially similar to the shape of the arrangement of first, second, third and fourth fins 12*a*, 12*b*, 14*a*, 14*b* (here an X-shape).

First substrate 16 and/or second substrate 25 may include a dielectric material. For example, and without limitation, first substrate 16 and/or second substrate 25 may be provided from one or a combination of materials including, but not limited to: high-density polyethylene (HDPE), polypropylene, polytetrafluoroethylene (PTFE) (e.g, Teflon), cyanate-ester resin (which is low loss and may be convenient because it is a low-viscosity liquid prior to curing and can be easily poured into a mold, other similar materials may also be used). In some embodiments, the first and second substrates 16, 25 may be provided as the same materials. In some embodiments, the first and second substrates 16, 25 may be different materials.

In some embodiments, each of fins 12*a*, 12*b*, 14*a*, 14*b* may be formed from a high-conductivity metal. For example, each of fins 12*a*, 12*b*, 14*a*, 14*b* may include aluminum. In some embodiments, each of fins 12*a*, 12*b*, 14*a*, 14*b* fins can be fabricated from polymers using an injection molding process. If it is critical for a particular application that a weight of tapered slot antenna 10 is minimized, each of fins 12*a*, 12*b*, 14*a*, 14*b* can be fabricated from any suitable lightweight material and then coated with a layer having high electrical conductivity. For example, in embodiments having polymer, each of fins 12*a*, 12*b*, 14*a*, 14*b* may be plated with a high-conductive material such as but not limited to aluminum, copper, gold, or silver. In an embodiment, a suitable lightweight material can be one having suitable mechanical properties, such as density, tensile strength, etc.

In some embodiments, each of fins 12*a*, 12*b*, 14*a*, 14*b* fins may be fabricated using an additive manufacturing technique such as Selective Laser Sintering (SLS) from high-strength polymers such as carbon-loaded nylon (e.g., Nytek 1200 CF), polyether ether ketone (PEEK), or polyetherketoneketone (PEKK). It should be appreciated that the dimensions and properties of tapered slot antenna 10 and each of first and second antenna elements 12, 14, and fins 12*a*, 12*b*, 14*a*, 14*b* can be scaled accordingly to meet requirements of a particular application.

The dimensions of unit cell 19 can be scaled accordingly to meet requirements of a particular application. For example, in one embodiment, a width and/or length of unit cell 19 may be one-half a wavelength of a highest operating frequency of tapered slot antenna 10.

Figure 2A:
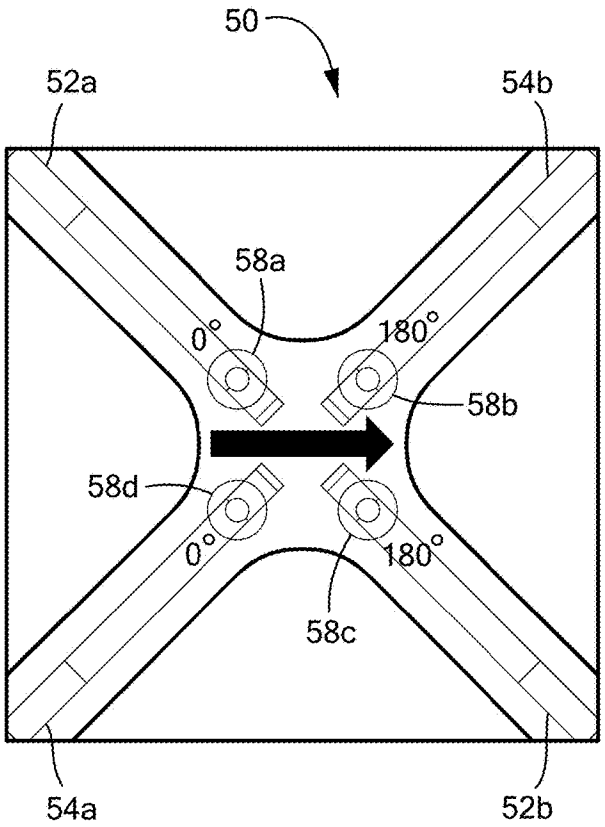
FIGS. 2-2C are bottom views of a tapered slot antenna in the form of an array unit cell, illustrating input configurations for various radiated polarization states.
Figure 2:
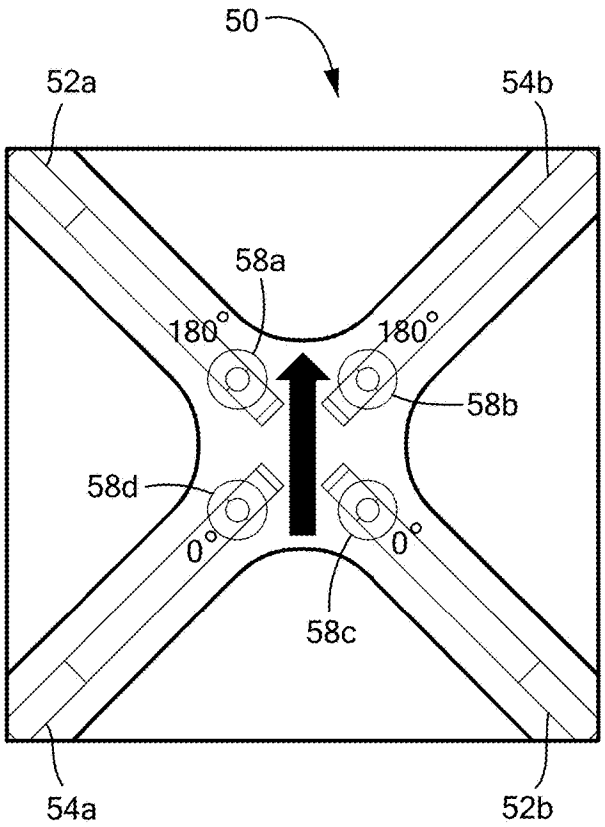
Figure 2C:
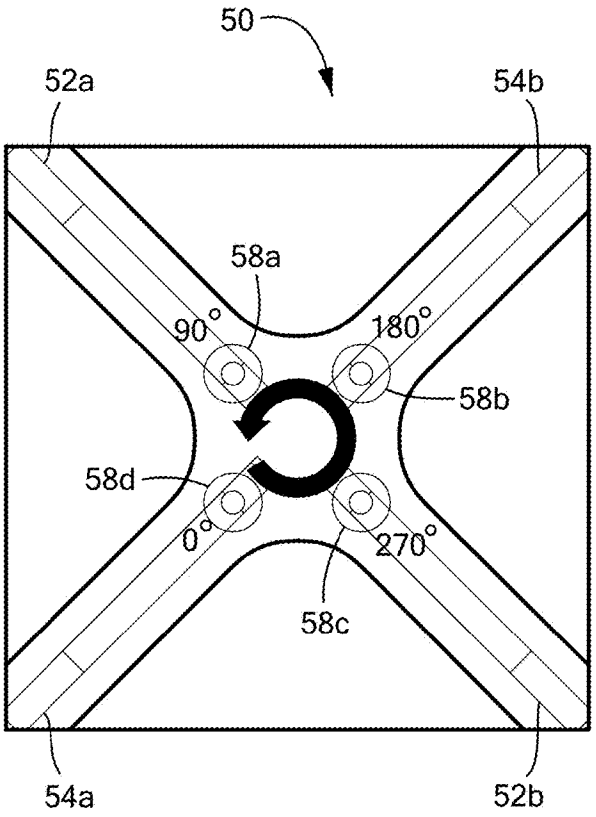

Now referring to FIGS. 2-2C, in which like elements are provided having like reference designations throughout the several views, an antenna system 50 includes first, second, third, and fourth fins 52*a*, 52*b*, 54*a*, 54*b* respectively. In an embodiment, first and second fins 52*a*, 52*b* form a first tapered slot antenna element and third and fourth fins 54*a*, 54*b* form a second tapered slot antenna element. First, second, third, and fourth fins 52*a*, 52*b*, 54*a*, 54*b* are arranged such that first and second tapered slot antenna elements are orthogonal to each other. Thus, a radiating slot 56 of each first and second tapered slot antenna elements intersect.

Each of first, second, third, and fourth fins 52*a*, 52*b*, 54*a*, 54*b* include an individual input port 58*a*, 58*b*, 58*c*, 58*d*, respectively. Input ports 58*a*, 58*b*, 58*c*, 58*d* can be coupled to a coaxial transmission line to receive an input signal. In an embodiment, antenna system 50 may be configured as a power combiner as it can combine a power received from each input signal. Each of the input signals can be coherent and thus have the same frequency. In some embodiments, the input signals may be radio-frequency (RF) signals.

A phase of the input signal applied to each of first, second, third, and fourth fins 52*a*, 52*b*, 54*a*, 54*b* can be controlled to modify a polarization of antenna system 50. Thus, in some embodiments, antenna system 50 includes up to four different inputs to provide for polarization diversity capability. For example, antenna system 50 can be configured for at least one of horizontal linear polarization, vertical linear polarization, left-hand circular polarization or right-hand circular polarization. The radiated polarization is determined by the phases applied to each of the inputs, which are equal in amplitude.

For example, and as illustrated in FIG. 2, antenna system 50 can be configured for vertical linear polarization when the input signal provided to third and fourth input ports 58*c*, 58*d* are in phase and the input signals provided to first and second input ports 58*a*, 58*b* have relative phases of 180° with respect to the input signals provided to third and fourth input ports 58*c*, 58*d*.

In FIG. 2A, horizontal linear polarization can be realized by driving first and fourth input ports 58*a*, 58*d* in phase while driving second and third input ports 58*b*, 58*c* with 180° relative phase shifts. For example, antenna system 50 can be configured for horizontal linear polarization when the input signal provided to first and fourth input ports 58*a*, 58*d* are in phase and the input signals provided to second and third input ports 58*b*, 58*c* have relative phases of 180° with respect to the input signal provided to first and fourth input ports 58*a*, 58*d*. It should be appreciated that a realized polarization of the antenna system 50 depends at least in part on the orientation of the phase distribution between each of the input ports 58*a*, 58*b*, 58*c*, 58*d* relative to the direction of the polarization.

Figure 2B:
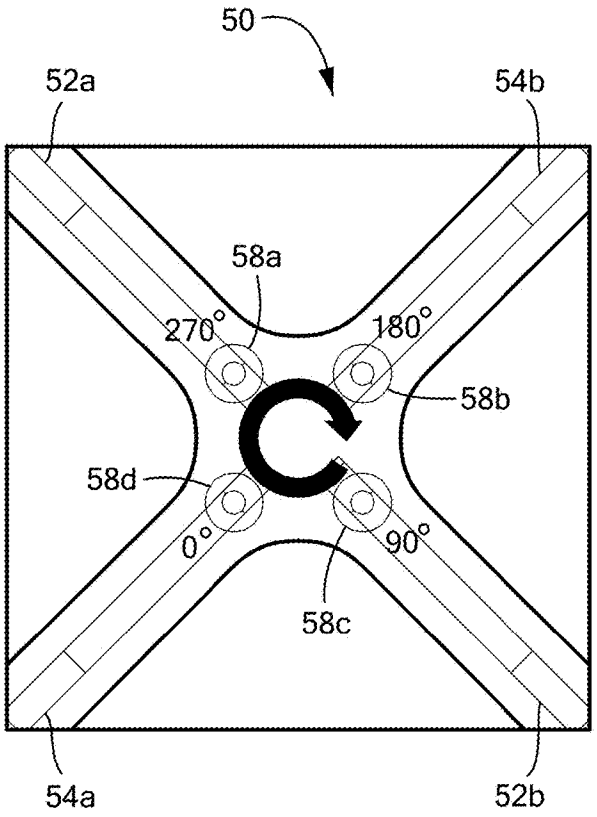

Circular polarization can be realized by driving neighboring input ports with a relative phase shift of 90°. For example, and as illustrated in FIG. 2B, antenna system 50 can be configured for right-hand circular polarization when the input signal provided to fourth input port 58*d* is in phase (e.g., 0°), the input signal provided to third input port 58*c* has a relative phase of 90° with respect to the input signal provided to fourth input port 58*d*, the input signal provided to second input port 58*b* has a relative phase of 180° with respect to the input signal provided to fourth input port 58*d*, and the input signal provided to first input port 58*a* has a relative phase of 270° with respect to the input signal provided to fourth input port 58*d*.

Now referring to FIG. 2C, antenna system 50 can be configured for left-hand circular polarization when the input signal provided to fourth input port 58*d* is in phase (e.g., 0°), the input signal provided to first input port 58*a* has a relative phase of 90° with respect to the input signal provided to fourth input port 58*d*, the input signal provided to second input port 58*b* has a relative phase of 180° with respect to the input signal provided to fourth input port 58*d*, and the input signal provided to third input port 58*c* has a relative phase of 270° with respect to the input signal provided to fourth input port 58*d*. It should be appreciated that FIGS. 2B-2C illustrate exemplary embodiments, and that first, second, third and fourth ports 58*a*, 58*b*, 58*c*, 58*d* can be driven by input signals having different phase shifts from those discussed above as along as neighboring input ports within a tapered slot antenna are driven with a relative phase shift of 90° with respect to each other.

In an embodiment, an active impedance match can be established between each of input ports 58*a*, 58*b*, 58*c*, 58*d*. For example, the active impedance match does not change as a phase of an input signal provided to one or more of first, second third and fourth fins 52*a*, 52*b*, 54*a*, 54*b* changes when fin-shaped members positioned diagonally from each other are fed with RF signals having the same frequency and 180° out of phase with respect to each other.

Figure 3:
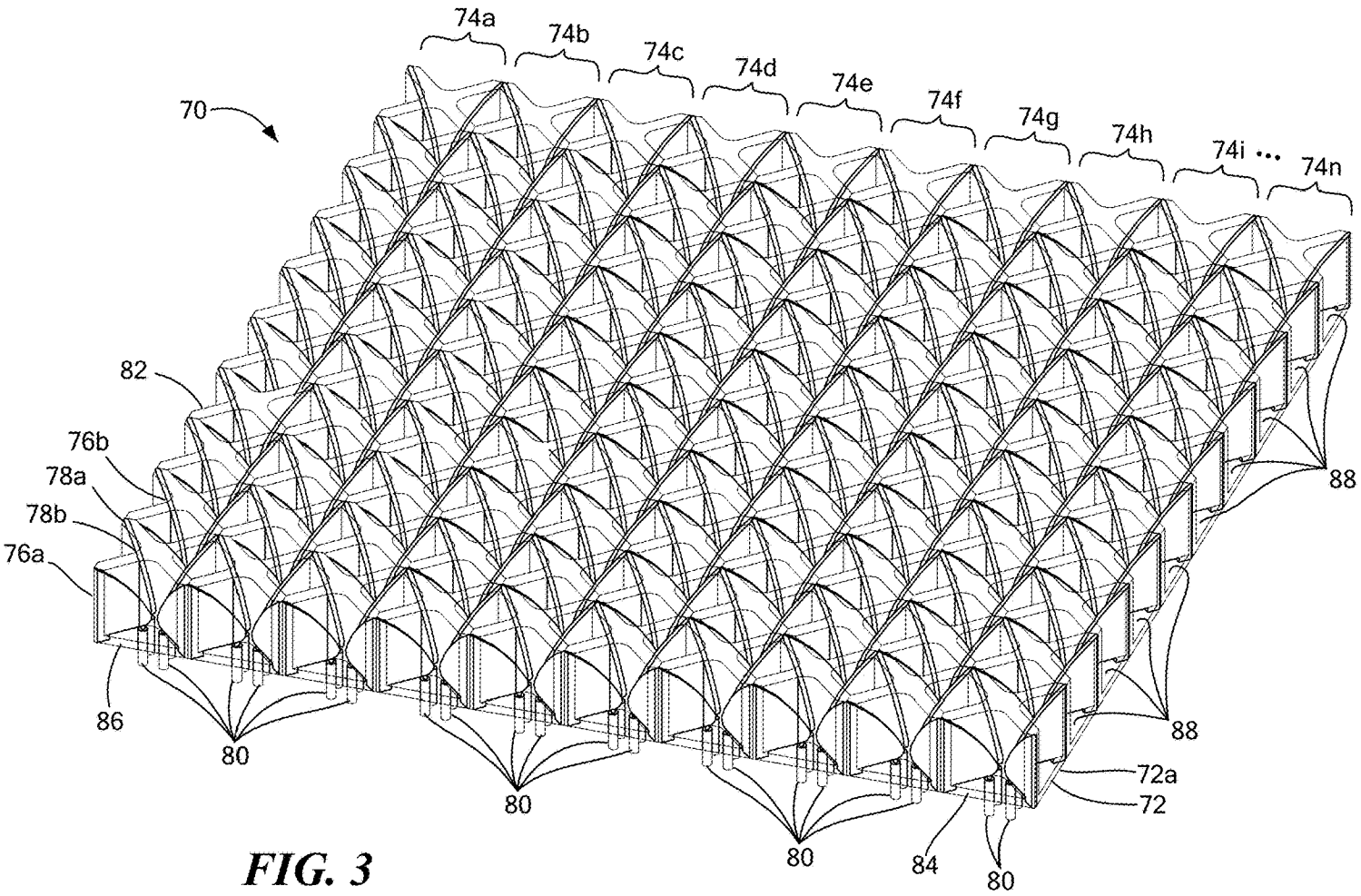
FIG. 3 is a view of an array of tapered slot antennas.

Now referring to FIG. 3, an array antenna system 70 includes a ground plane 72 and a plurality of first and second antenna elements 76, 78 coupled to a first surface 72*a* of ground plane 72. Each first antenna element 76 includes a first fin 76*a* and a second fin 76*b* and a first radiating slot is formed by a spacing between the first and second fins 76*a*, 76*b*. Each second antenna element 78 includes a third fin 78*a* and a fourth fin 78*b* and second radiating slot is formed by a spacing between the third and fourth fins 78*a*, 78*b*.

In an embodiment, each pair of first and second antenna elements 76, 78 may be the same as or substantially similar to tapered slot antenna 10 described above with respect to FIGS. 1-1C and antenna system 50 described above with respect to FIGS. 2-2C. Thus, each of first and second antenna elements 76, 78 may be the same as or substantially similar to first and second antenna elements 12, 14 described above with respect to FIG. 1. Each of first, second, third, and fourth fins 76*a*, 76*b*, 78*a*, 78*b* may be the same as or substantially similar to each of first, second, third, and fourth fins 12*a*, 12*b*, 14*a*, 14*b* described above with respect to FIG. 1 and each of first, second third and fourth fins 52*a*, 52*b*, 54*a*, 54*b* described above with respect to FIGS. 2-2C. Thus, array 70 may include a plurality of tapered slot antennas, such as tapered slot antenna 10 described above with respect to FIG. 1-1C. Or a plurality of antenna systems, such as antenna system 50 described above with respect to FIGS. 2-2C.

For example, array 70 includes a plurality of pairs of first and second antenna elements 78, 78 orthogonally arranged with respect to each other such that their respective radiating slots intersect. Each pair of first and second antenna elements 76, 78 provides at least part of a unit cell and the array is made up of a plurality of unit cells 74*a*-74*n* within array 70. Unit cells 74*a*-74*n* may be organized in a regular spacing along the first surface 72*a* of ground plane 72, thus a plurality of pairs of first and second antenna elements 78, 78 are organized in a regular spacing along the first surface 72*a* of ground plane 72.

A first substrate 82 is disposed about the plurality of first and second antenna elements 76, 78 and their respective slots. How first substrate 82 is disposed about array 70 may be determined based at least in part on a weight requirement of array 70. For example, in some embodiments, first substrate 82 may encase each fin of the plurality of pairs of first and second antenna elements 768, 78. First substrate 82 may fill or otherwise cover each radiating slot within array 70. Thus, first substrate 82 may be disposed such that cavities 88 may be formed between each of the first, second, third and fourth fins 12*a*, 12*b*, 14*a*, 14*b* within array 70. In some embodiments, first substrate 82 may be disposed such that it covers array 70 (e.g., no cavities are formed). In an embodiment, array 70 having cavities 88 formed may have a lower overall weight than an array having first substrate 82 disposed such that it covers array 70.

The plurality of pairs of first and second antenna elements 76, 78 are disposed over a surface 72*a* (here top) of a ground plane 72. A feed slot 86 may be formed between a bottom portion of each of the first, second, third and fourth fins 76*a*, 76*b*, 78*a*, 78*b* in each pair of first and second antenna elements 76, 78 and ground plane 72. The feed slot 86 may include a second substrate 84 that separates the bottom portion of each of the first, second, third and fourth fins 76*a*, 76*b*, 78*a*, 78*b* and ground plane 72. For example, the second substrate 84 may be disposed over the surface 72*a* of ground plane 72 and thus fill a cavity formed by feed slot 86 between the bottom portion of each of the first, second, third and fourth fins 76*a*, 76*b*, 78*a*, 78*b* and ground plane 72.

Within array 70, each first, second, third, and fourth fins 76*a*, 76*b*, 78*a*, 78*b* includes an individual input port 80. Thus, each until cell 72 in array 70 can be provided up to four separate input signals with relationships as described above. For example, it should be appreciated however that fins positioned diagonally from each other within each unit cell 72 can be fed with RF signals having the same frequency and 180° out of phase with respect to each other. For example, first and second fins 76*a*, 76*b* form the first antenna element 76 and third and fourth fins 78*a*, 78*b* form the second antenna element 78. Thus, first and second fins 76*a*, 76*b* can be provided RF signals having a first frequency and 180° out of phase with respect to each other and third and fourth fins 78*a*, 78*b* can be provided RF signals having a second frequency and 180° out of phase with respect to each other. Thus, each unit cell 72 can be configured to radiate two different frequencies simultaneously by providing each of first and second antenna elements 76, 78 an RF signal at a different frequency within an operating bandwidth of array 70.

The different input ports 80 allows for polarization diversity across array 70. For example, each of the plurality of pairs of first and second antenna elements 76, 78 can be configured for at least one of horizontal linear polarization, vertical linear polarization, left-hand circular polarization or right-hand circular polarization. In an embodiment, a phase of the input signal applied to each of first, second third and fourth fins 76*a*, 76*b*, 78*a*, 78*b* within each pair of first and second antenna elements 76, 78 can be controlled to modify a polarization of the respective pair of first and second antenna elements 76, 78.

In an embodiment, an active impedance match can be established between each input port 80 to first, second third and fourth fins 76*a*, 76*b*, 78*a*, 78*b* within each pair of first and second antenna elements 76, 78. The active impedance match does not change as a phase of an input signal provided to one or more of first, second third and fourth fins 76*a*, 76*b*, 78*a*, 78*b* changes when fin-shaped members positioned diagonally from each other are fed with RF signals having the same frequency and 180° out of phase with respect to each other. Thus, in an embodiment, array 70 achieves an active impedance match at each input port 80 over an entire operating bandwidth.

Active S-parameters at each input port 80 can be unaffected by changes in the relative phases required to realize the different radiated polarizations. In some embodiments, the properties and/or dimensions of each first, second third and fourth fins 76*a*, 78*b*, 78*a*, 78*b* within each pair of first and second antenna elements 76, 78 in array 70 can be selected based at least in part of desired active S-parameter performance.

It should be appreciated that the active impedance match discussed above may refer to embodiments involving broadside beam steering (i.e., where the direction of the beam is normal to the array). For example, this may result when all the beam steering phases are set to zero. Thus, when the beam is steered, mutual coupling between neighboring array elements can cause the active impedance match to degrade (gradually, not abruptly). A person of ordinary skill in the art will appreciate that the active impedance may degrade as the beam is steered away from the broadside direction, and that this degradation may limit the maximum beam steering angles.

In some embodiments, the gain of array 70 may perform within predetermined limits. For example, the co and cross-polarized gain patterns of array 70 may be the same as or substantially similar to a uniform aperture having the same dimensions as array of 70. Array 70 may demonstrate polarization purity, which refers to the difference between co and cross-polarized gain. For example, in one embodiment, the boresight co-polarized gain can exceed that of the cross-polarized component of array 70 by a significant amount (e.g., 30 dB or more) at all operating frequencies.

Array 70 can be a phased array formed using a plurality of unit cells 72 arranged in rows and columns, for example, with each unit cell 72 including a tapered slot antenna. The phased array can generate a beam that can be steered by applying progressive phase shifts across the rows and columns of unit cells 72 within array 70. The beam steering phases can be independent of phase changes needed to implement polarization diversity (e.g., polarization diversity as discussed above with respect to FIGS. 2-2C).

In some embodiments, a change in a phase for a particular array element in a unit cell 72 (e.g., a tapered slot antenna) can be common to all four inputs of the respective unit cell 72. Thus, the change in the phase can be common to an input signal provided to each of first, second third and fourth fins 76*a*, 76*b*, 78*a*, 78*b* forming the respective unit cell 72.

For example, in one embodiment, a unit cell 72 in row m and column n of an M×N array 70 can have an input for each of first, second, third, and fourth fins 76*a*, 76*b*, 78*a*, 78*b*. The inputs can be numbered 1-4, for each of first, second, third, and fourth fins 76*a*, 76*b*, 78*a*, 78*b*, respectively. The phase changes to set a desired polarization applied to each of first, second, third, and fourth fins 76*a*, 76*b*, 78*a*, 78*b* can be denoted by $\theta_1(m,n)$, $\theta_2(m,n)$, $\theta_3(m,n)$, and $\theta_4(m,n)$, respectively. Thus, to steer the beam (e.g., in azimuth and elevation) generated by array 70, an additional phase is required, one that is common to all four inputs of the $(m,n)^{th}$ unit cell 72, such that the total phases applied to the four inputs are as follows:

$$\Theta_1(m,n)=\theta_1(m,n)+\Phi(m,n),$$

$$\Theta_2(m,n)=\theta_2(m,n)+\Phi(m,n),$$

$$\Theta_3(m,n)=\theta_3(m,n)+\Phi(m,n),$$

$$\Theta_4(m,n)=\theta_4(m,n)+\Phi(m,n),$$

Where $\Phi(m,n)$ is the beam-steering phases, which is a function of the frequency, the array element spacing, and the beam-steering direction. Thus, each of first, second, third, and fourth fins 76*a*, 76*b*, 78*a*, 78*b* can receive the same beam-steering phase, $\Phi(m,n)$.

A number of embodiments of the disclosure have been described. Nevertheless, it will be understood that various modifications may be made without departing from the spirit and scope of the disclosure. Elements of different embodiments described herein may be combined to form other embodiments not specifically set forth above. Other embodiments not specifically described herein are also within the scope of the following claims.

What is claimed:

1. An antenna comprising:

a ground plane;

a first antenna element disposed over said ground plane, said first antenna element comprising first and second fin-shaped members disposed to form a first slot antenna element, each of the first and second fin-shaped members having first and second input ports respectively;

a second antenna element disposed over said ground plane, said second antenna element comprising third and fourth fin-shaped members disposed to form a second slot antenna element, each of the third and fourth fin-shaped members having third and fourth input ports respectively;

a dielectric material disposed about the first and second antenna elements to encapsulate one or more of the fin-shaped members; and said first and second antenna elements orthogonally arranged with respect to each other such that a slot portion of each of the first and second antenna elements intersects.

2. The antenna of claim 1, wherein the first and second antenna elements are each provided as a tapered slot antenna.

3. The antenna of claim 1, wherein each of the first, second, third and fourth fin-shaped members include a feed portion.

4. The antenna of claim 3, wherein the feed portion comprises a circular transition from the feed portion to a radiating portion of each of the first, second, third and fourth fin-shaped members.

5. The antenna of claim 1, further comprising a second substrate disposed between each of the first, second, third, and fourth fin-shaped members and the ground plane.

6. The antenna of claim 5, wherein each of the first, second, third, and fourth fin-shaped members comprise a feed slot and the second substrate is disposed in the feed slot.

7. The antenna of claim 6, wherein a length of the feed slot is approximately equal to one quarter wavelength at a center frequency.

8. The antenna of claim 7, wherein each of the first, second, third and fourth fin-shaped members are arranged to radiate at least one of linear or circular polarization, based upon a relative phase applied to the respective input ports through the coaxial transmission lines.

9. The antenna of claim 5, wherein the input ports are coupled to coaxial transmission lines.

10. The antenna of claim 9, wherein each of the coaxial transmission lines includes an inner conductor that extends through a hole formed in the ground plane and the second substrate.

11. An array antenna comprising:

a ground plane;

a plurality of first antenna elements disposed over said ground plane, each of said first antenna elements disposed to form a first slot antenna element comprising first and second fin-shaped members, each of the first and second fin-shaped members having first and second input ports respectively;

a plurality of second antenna elements disposed over said ground plane, each of said second antenna elements disposed to form a second slot antenna element comprising third and fourth fin-shaped members, each of the third and fourth fin-shaped members having third and fourth input ports respectively;

a dielectric material disposed about the first and second antenna elements to encapsulate one or more of the fin-shaped members; and wherein the first and second slot antenna elements are orthogonally arranged with respect to each other such that a slot portion of each slot antenna element intersects.

12. The array of claim 11, wherein the pairs of first and second slot antenna elements are disposed in a regular spacing along a surface of the ground plane.

13. The array of claim 11, wherein the slot portion of the first antenna element is formed by a spacing between the first and second fin-shaped members and the slot portion of the second antenna element is formed by a spacing between the third and fourth fin-shaped members.

14. The array of claim 11, wherein each of the first, second, third and fourth fin-shaped members include a feed portion.

15. The array of claim 14, wherein the feed portion comprises a circular transition from the feed portion to a radiating portion of each of the first, second, third and fourth fin-shaped members.

16. The array of claim 15, further comprising a feed slot formed between a bottom portion of each of the first, second, third, and fourth fin-shaped members and a surface of said ground plane, said feed slot having a second substrate disposed therein.

17. The array of claim 16, further comprising a plurality of coaxial transmission lines, each of the plurality of coaxial transmission lines having an inner conductor and an outer conductor and wherein each inner conductor is disposed through and spaced apart from said ground plane and coupled to a portion of at least one first, second, third or fourth fin-shaped members and each outer conductor of said plurality of coaxial transmission lines is coupled to said ground plane.

18. A method for controlling a polarization of an antenna, the method comprising:

providing a first input signal to a first fin-shaped member and a second input signal to a second fin-shaped member, each of said first and second fin-shaped members arranged to form a first antenna element;

providing a third input signal to a third fin-shaped member and a fourth input signal to a fourth fin-shaped member, each of said third and fourth fin-shaped members arranged to form a second antenna element; said first and second antenna elements orthogonally arranged with respect to each other such that a slot portion of each of the first and second antenna elements intersects and said first and second antenna elements form a tapered slot antenna;

encapsulating one or more of the fin-shaped members in a dielectric material disposed about the first and second antenna elements; and modifying a phase provided to at least one of the first, second, third or fourth input signals to change a polarization of the tapered slot antenna such that the tapered slot antenna radiates in at least one of a linear polarization or a circular polarization.

19. The method of claim 18, further comprising generating the circular polarization by driving neighboring input ports of each of first, second, third and fourth fin-shaped members with input signals having a relative phase shift of 90°.

20. The method of claim 18, further comprising generating at least one of a vertical linear polarization or a horizontal linear polarization by driving neighboring input ports of at least two of first, second, third and fourth fin-shaped members with input signals having a relative phase of 180° with respect to the input signals provided to the other two of first, second, third and fourth fin-shaped members.

21. The method of claim 18, further comprising:

providing the first and second input signals at a first frequency and 180° out of phase with respect to each other; and providing the third and fourth input signals at a second frequency and 180° out of phase with respect to each other such that the tapered slot antenna is configured to operate at the first and second frequencies.

22. An antenna comprising:

a ground plane;

a first antenna element disposed over said ground plane, said first antenna element comprising first and second fin-shaped members disposed to form a first slot antenna element, each of the first and second fin-shaped members having an input port;

said first and second fin-shaped members having a feed portion and a feed slot, said feed portion comprising a circular transition from the feed portion to a radiating portion of each of the first and second fin shaped members, and said feed slot is formed between each of said first and second fin-shaped members and the ground plane;

a dielectric material disposed about the first antenna element to encapsulate one or more of the fin-shaped members; and a substrate disposed in the feed slot between the feed portions of the first and second fin-shaped members and the ground plane.

23. The antenna of claim 22, further comprising a second antenna element disposed over said ground plane, said second antenna element comprising third and fourth fin-shaped members disposed to form a second slot antenna element, each of the third and fourth fin-shaped members having an input port.

said third and fourth fin-shaped members having another feed portion and the feed slot, said feed portion comprising the circular transition from the feed portion to a radiating portion of each of the third and fourth fin shaped members, and said feed slot is formed between each of said third and fourth fin-shaped members and the ground plane; and the substrate disposed in the feed slot between the other feed portions of the third and fourth fin-shaped members and the ground plane.

24. The antenna of claim 23, further comprising arranging said first and second antenna elements orthogonally with respect to each other such that a slot portion of each of the first and second antenna elements intersects.

* * * * *